United States Patent [19]

Billany et al.

[11] 3,960,745

[45] *June 1, 1976

[54] CLEANSING COMPOSITIONS

[75] Inventors: Michael Royston Billany; Arthur Raymond Longworth; John Shatwell, all of Macclesfield, England

[73] Assignee: Imperial Chemical Industries Limited, London, England

[ * ] Notice: The portion of the term of this patent subsequent to Dec. 17, 1991, has been disclaimed.

[22] Filed: Oct. 4, 1974

[21] Appl. No.: 512,483

Related U.S. Application Data

[63] Continuation of Ser. No. 253,102, May 15, 1972, Pat. No. 3,855,140.

[30] Foreign Application Priority Data

June 18, 1971 United Kingdom ..... 28764/71

[52] U.S. Cl. ..... 252/106; 252/547; 424/326

[51] Int. Cl.[2] ..... C11D 3/48; C11D 1/72

[58] Field of Search ..... 252/106, 107, 547; 424/326

[56] References Cited

UNITED STATES PATENTS

| | | | |
|---|---|---|---|
| 3,296,145 | 1/1967 | Findland et al. | 252/106 |
| 3,324,183 | 6/1967 | Priestley | 260/584 |
| 3,855,140 | 12/1974 | Billany et al. | 252/106 |

FOREIGN PATENTS OR APPLICATIONS

| | | |
|---|---|---|
| 159,111 | 9/1954 | Australia |
| 745,064 | 2/1956 | United Kingdom |
| 815,800 | 7/1959 | United Kingdom |
| 815,925 | 7/1959 | United Kingdom |
| 993,044 | 5/1965 | United Kingdom |
| 1,202,496 | 8/1970 | United Kingdom |

OTHER PUBLICATIONS

"Pluronics," Wyandotte Chem. Corp., Sept., 1954, pp. 2–4, 8 and 9.

"Aromox Amine Oxides–New Products, Applications, Opportunies," Armour & Co., Feb., 1964, pp. 1,2,4–7.

"Pluronic Polyols in Cosmetics," Wyandotte Chem. Corp., 1968, pp. 1 and 5–17.

*Primary Examiner*—P. E. Willis, Jr.
*Attorney, Agent, or Firm*—Cushman, Darby & Cushman

[57] ABSTRACT

The disclosure relates to cleansing compositions containing a soluble salt of chlorhexidine, a polyoxyethylene-polyoxypropylene block co-polymer and an inert diluent or carrier.

4 Claims, No Drawings

CLEANSING COMPOSITIONS

This is a continuation of application Ser. No. 253,102, filed May 15, 1972, now U.S. Pat. No. 3,855,140.

This invention relates to cleansing compositions, and in particular it relates to cleansing compositions, containing the antibacterial compound chlorhexidine or a salt thereof, which are suitable for skin cleansing. The compositions of the invention are therefore useful in surgical practice as a pre-operative scrub; they may be used routinely by hospital ward staff.

The essential constituents of such a composition are a suitable salt of chlorhexidine and a surfactant. Very many common surfactants are, however, incompatible with chlorhexidine. Thus, anionic surfactants are known to destroy the antibacterial activity of chlorhexidine solutions by complexing with the cationic chlorhexidine, and cationic surfactants are not preferred because of their irritancy, and because in combination with a soluble chlorhexidine salt double decomposition can occur, with the formation of insoluble chlorhexidine salts and consequent loss of antibacterial activity. Amphoteric surfactants, which contain either anionic or cationic centres depending upon pH, suffer from the above described disadvantages of anionic and cationic surfactants, and are therefore equally unsuitable for the present purpose. Thus, for example, of thirteen amphoteric surfactants examined as aqueous solutions containing 20% w/v of surfactant and 2% v/v of chlorhexidine gluconate (provided as a 20% w/v solution in water) the best combination possessed only 14% of the antibacterial activity of a 2% solution of chlorhexidine gluconate alone.

Non-ionic surfactants were therefore examined in combination with chlorhexidine gluconate (20% w/v of surfactant and 2% v/v of chlorhexidine gluconate provided as a 20% w/v solution) in water. Of seventeen non-ionic surfactants of various types which were investigated, only four possessed 70% or more of the antibacterial activity of a 2% solution of chlorhexidine gluconate alone. These four non-ionic surfactants were all members of a class of polyoxyethylene/polyoxypropylene block copolymers of the general formula:

$$HO-(CH_2.CH_2.O)_a(\underset{\underset{CH_3}{|}}{CH}.CH_2.O)_b(CH_2.CH_2.O)_cH$$

wherein *a*, *b* and *c* are integers, having molecular weights between 1000 and 16000, and in which the terminal polyoxyethylene chains represent 10–80% of the molecule, which copolymers are available commercially under the trade name "pluronic." However, from the results of comparative tests, we have found that not all "pluronics" are equally suitable for the present purpose.

Thus, according to the invention there is provided a composition comprising from 0.5 to 10.0% w/v of a salt of chlorhexidine which is soluble to the extent of at least 0.5% w/v in water at ambient temperature, and a polyoxyethylenepolyoxypropylene block copolymer consisting of 20–80% of polyoxyethylene, and wherein the polyoxypropylene part of the polymer molecule has a molecular weight of between 1000 and 2750, together with an inert diluent or carrier.

Suitable salts of chlorhexidine which are soluble in water at ambient temperature to the extent of at least 0.5% w/v are, for example, the gluconate, isethionate (2-hydroxyethanesulphonate), formate, acetate, glutamate, succinamate, monodiglycollate, di-methanesulphonate, lactate, di-isobutyrate and glucoheptonate, and of these, the gluconate is particularly preferred.

Particular polyoxyethylene-polyoxypropylene block copolymers which are useful in the compositions of the invention are those known as "Pluronics," and having the following designations, (wherein the figures in parentheses following the designation indicate the typical molecular weight of the polyoxypropylene part of the molecule, and the percentage of polyoxyethylene in the molecule, respectively):

L44 (1200, 40), L62 (1750, 20), L63 (1750, 30), L64 (1750, 40), P65 (1750, 50), F68 (1750, 80), P75 (2050, 50), F77 (2050, 70), P84 (2250, 40), P85 (2250, 50) and F87 (2250, 70).

Preferred "Pluronics" are those comprising 40 to 70% of polyoxyethylene, and wherein the typical molecular weight of polyoxypropylene is between about 2000 and about 2500. Particularly preferred "Pluronics" are those with a polyoxypropylene typical molecular weight of about 2250, and containing 40 to 70% of polyoxyethylene, that is "Pluronics" P84, P85 and F87, which possess the optimum combination of foaming ability, mild detergency, viscosity, water solubility and non-irritancy. The surfactant of choice is "Pluronic"F87.

Preferred compositions contain from 10 to 30% of "Pluronic" F87, ideally about 25%, and from 0.5 to 5.0% of chlorhexidine gluconate.

For user acceptability, the compositions should preferably possess moderate foaming properties, and to achieve this it is necessary to include a foaming agent. Most foaming agents deactivate chlorhexidine to a large extent, but with amine oxide foaming agents the deactivation is kept to a minimum. Nevertheless, some deactivation is unavoidable, so it is preferable to use a surfactant having maximum foaming properties, so that the quantity of deactivating foaming agent is kept to a minimum. "Pluronics" P84, P85 and F87 have the greatest foaming ability and with these, the addition of 3.75% of an amine oxide foaming agent gives a composition having acceptable foaming properties, but with other "Pluronics" it is necessary, in order to obtain a sufficiently foaming composition, to increase the quantity of foaming agent incorporated, and to increase also the quantity of chlorhexidine in order to overcome the deactivating effect of the additional foaming agent.

Suitable amine oxide foaming agents are, for example, cetyldimethylamine oxide, lauryldimethylamine oxide, cetylmethylmyristylamine oxide and dimethylmyristylamine oxide, and of these, cetyldimethylamine oxide is preferred as being the most stable and the least deactivating as a constituent of the composition of this invention.

An especially preferred group of compositions of the invention comprises those compositions containing 0.5 to 5.0% of chlorhexidine gluconate, about 25% of a copolymer as described above containing 40 to 70% of polyoxyethylene, and with a polyoxypropylene typical molecular weight of about 2250, and about 3.75% of an amine oxide foaming agent, selected from those named above, together with an inert diluent or carrier.

The compositions may also optionally contain perfumes, colouring agents and preservatives, for example isopropyl alcohol, ethyl alcohol, methyl p-hydroxybenzoate or propyl p-hydroxybenzoate. It is also advantageous to adjust the pH of the composition to between 5 and 7, preferably to about 5.5, to minimise the precipitation of insoluble chlorhexidine salts on storage. A suitable agent for adjusting the pH of the compositions is, for example, gluconolactone, or the acid from which the anion of the chlorhexidine salt in use is derived.

The invention is illustrated but not limited by the following Examples in which the parts are by weight:

EXAMPLE 1

Chlorhexidine gluconate (20 parts of a 20% w/w solution), lauryldimethylamine oxide (3.75 parts) and water (47.145 parts) are heated to 60°C. with stirring, then "Pluronic" F87 (25 parts) is added slowly, with continuous stirring until all is dissolved. The solution is cooled, and isopropyl alcohol (4 parts), Edicol Supra Carmoisine W.S. (0.005 part) and Herbacol 15.393/T (0.1 part) are added, in any order. The pH of the preparation is then adjusted to 5.5 by the addition of 6 parts of a 10% w/v solution of d-gluconolactone.

EXAMPLE 2

The process described in Example 1 is repeated, using 0.05% w/v of Edicol Supra Ponceau 4RS is place of Edicol Supra Carmoisine W.S., and adjusting the water content in proportion.

What we claim is:

1. A skin cleansing composition consisting essentially of from 0.5 to 10.0% w/v of a salt of chlorhexidine which is soluble to the extent of at least 0.5% w/v in water at ambient temperature, selected from the group consisting of the gluconate, isethionate, formate, acetate, glutamate, succinamate, mono-diglycollate, dimethanesulphonate, lactate, diisobutyrate and glucoheptonate salts, between 10 and 30% of a polyoxyethylene-polyoxypropylene block copolymer of the formula:

$$HO-(CH_2.CH_2.O)_a(\underset{\underset{CH_3}{|}}{CH}.CH_2.O)_b(CH_2.CH_2.O)_cH$$

wherein *a*, *b* and *c* are integers, such that said copolymer consists of 40 to 70% of polyoxyethylene and wherein the molecular weight of the polyoxypropylene content is between 2000 and 2500, and water.

2. The composition of claim 1 which contains from 0.5 to 5.0% of chlorhexidine gluconate.

3. The composition of claim 1 which additionally contains an amine oxide foaming agent selected from the group consisting of cetyldimethylamine oxide, lauryldimethylamine oxide, cetylmethylmyristylamine oxide and dimethylmyristylamine oxide.

4. A composition according to claim 1 wherein gluconolactone is included to provide a pH between 5 and 7.

* * * * *